US009955792B2

(12) United States Patent
Miller

(10) Patent No.: US 9,955,792 B2
(45) **Date of Patent: *May 1, 2018**

(54) MOBILITY ASSISTANCE DEVICES AND RELATED METHODS

(71) Applicant: Stander Inc., Logan, UT (US)

(72) Inventor: F. Troy Miller, Logan, UT (US)

(73) Assignee: Stander Inc., Logan, UT (US)

( * ) Notice: Subject to any disclaimer, the term of this patent is extended or adjusted under 35 U.S.C. 154(b) by 21 days.

This patent is subject to a terminal disclaimer.

(21) Appl. No.: 15/249,791

(22) Filed: Aug. 29, 2016

(65) Prior Publication Data

US 2016/0360895 A1 Dec. 15, 2016

Related U.S. Application Data

(63) Continuation of application No. 14/173,078, filed on Feb. 5, 2014, now Pat. No. 9,427,088.

(51) Int. Cl.

| | |
|---|---|
| ***A47C 21/08*** | (2006.01) |
| ***A61G 7/053*** | (2006.01) |
| ***A61G 7/05*** | (2006.01) |

(52) U.S. Cl.

CPC ..... *A47C 21/08* (2013.01); *A61G 7/053* (2013.01); *A61G 7/0507* (2013.01); *A61G 7/0513* (2016.11); *A61G 7/0518* (2016.11); *Y10T 29/49826* (2015.01)

(58) Field of Classification Search

CPC ..... A61G 7/05; A61G 7/0507; A61G 2007/0508; A61G 2007/0509; A61G 2007/051; A61G 2007/0513; A61G 2007/0514; A61G 2007/0515; A61G 2007/0516; A61G 2007/0518; A61G 2007/0519; A61G 7/053; A47C 21/00; A47C 21/08

USPC ..... 5/662, 659, 658, 503.1–506.1, 424–426, 5/428–430

See application file for complete search history.

(56) References Cited

U.S. PATENT DOCUMENTS

| | | | |
|---|---|---|---|
| 2,602,171 | A | 7/1952 | Good |
| 3,220,024 | A | 8/1963 | Nelson |
| 3,262,133 | A | 7/1966 | Beitzel |
| 3,290,701 | A | 12/1966 | Luff |
| 3,474,473 | A | 10/1969 | Hannaberg |
| 4,724,559 | A | 2/1988 | Bly et al. |
| 5,329,658 | A | 7/1994 | Fontenot |
| 5,448,791 | A | 9/1995 | Brown |
| 5,463,784 | A | 11/1995 | Alpern |

(Continued)

OTHER PUBLICATIONS

Home-Style Bed Rails, http://www.jamesonmedical.com/pages/bed_rails printed Oct. 11, 2005, 1 pg.

(Continued)

*Primary Examiner* — Robert G Santos
(74) *Attorney, Agent, or Firm* — Stoel Rives LLP

(57) ABSTRACT

Extendable mobility assistance devices for use with a bed are disclosed herein. The mobility assistance devices include base legs that are inserted between a mattress and a box spring and a support rail that extends upward from the base legs. The support rail has an adjustable longitudinal dimension. The support rail and base legs are configured to be reversibly arranged in a first orientation or a second orientation, for use on either side of a bed.

20 Claims, 4 Drawing Sheets

(56) References Cited

U.S. PATENT DOCUMENTS

| | | | | |
|---|---|---|---|---|
| 5,640,726 | A | 6/1997 | Fishner-Rathus | |
| 6,138,301 | A | 10/2000 | Battiston | |
| 6,401,280 | B1 | 6/2002 | Baker | |
| 6,519,794 | B1 | 2/2003 | Aarestad et al. | |
| 6,560,794 | B2 | 5/2003 | Allen et al. | |
| 6,813,789 | B2 | 11/2004 | Leoutsakos | |
| 6,990,697 | B1 | 1/2006 | Clute | |
| 7,013,508 | B2 | 6/2006 | Wu | |
| 7,103,928 | B1 | 9/2006 | Childs | |
| 7,197,779 | B2 | 4/2007 | Shalikar | |
| 7,373,679 | B2 | 5/2008 | Miller | |
| D701,069 | S | 3/2014 | Miller | |
| 8,973,192 | B2 | 3/2015 | Miller | |
| 9,427,088 | B2 | 8/2016 | Miller | |
| D798,641 | S * | 10/2017 | Miller | A61G 7/00 D6/718.3 |
| 2004/0049855 | A1 | 3/2004 | Leoutsakos | |
| 2005/0262632 | A1 | 12/2005 | Wu | |
| 2006/0037140 | A1 | 2/2006 | Clute | |
| 2007/0083994 | A1 | 4/2007 | Miller | |
| 2012/0117926 | A1 | 5/2012 | Miller | |
| 2015/0216750 | A1 | 8/2015 | Miller | |
| 2016/0360895 | A1 * | 12/2016 | Miller | A47C 21/08 |

OTHER PUBLICATIONS

SeniorShops, Carex Adjustable Bed Rails, http://www.seniorshops.com/bedrails1.html printed Oct. 11, 2005, 2 pgs.

Notice of Allowance dated Jul. 20, 2017 for U.S. Appl. No. 29/576,240.

* cited by examiner

MOBILITY ASSISTANCE DEVICES AND RELATED METHODS

CROSS-REFERENCE TO RELATED APPLICATIONS

This application is a continuation of U.S. patent application Ser. No. 14/173,078, entitled "MOBILITY ASSISTANCE DEVICES AND RELATED METHODS," filed Feb. 5, 2014, the contents of which are hereby incorporated herein by reference in their entirety.

TECHNICAL FIELD

The present disclosure relates generally to mobility assistance devices. More specifically, the present disclosure relates to extendable mobility assistance devices, such as bed rail devices, and methods related thereto.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Figure 1:
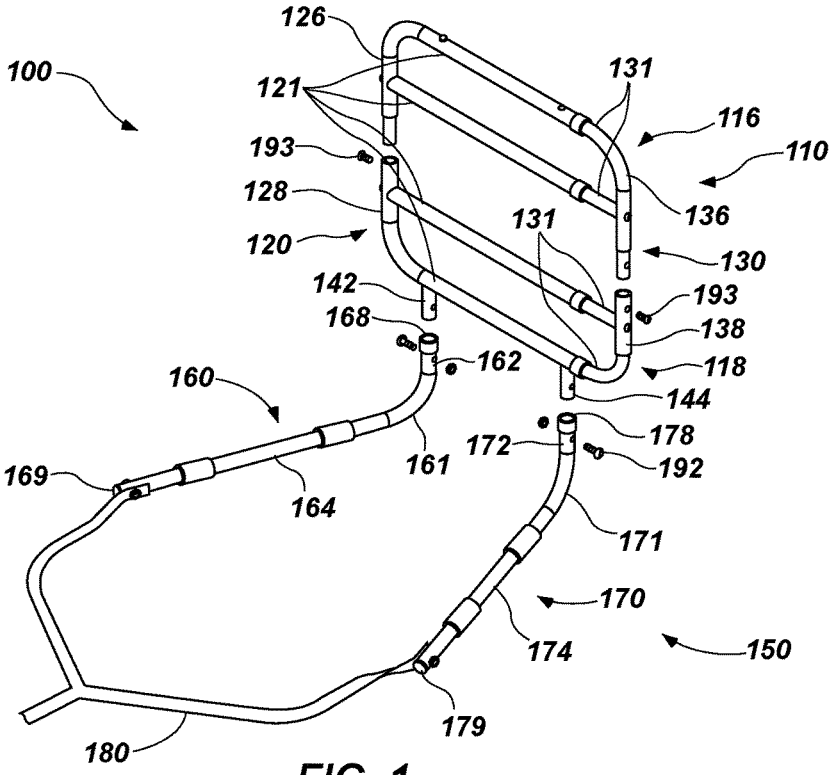
FIG. 1 is an exploded perspective view of one embodiment of a mobility assistance device in a first orientation in a retracted configuration.

Mobility assistance devices and related methods are disclosed herein. It will be readily understood that the components of the embodiments as generally described and illustrated in the figures herein could be arranged and designed in a wide variety of different configurations. Thus, the following more detailed description of various embodiments, as represented in the figures, is not intended to limit the scope of the present disclosure, but is merely representative of various embodiments. While various aspects of the embodiments are presented in drawings, the drawings are not necessarily drawn to scale unless specifically indicated.

The phrases "connected to," "coupled to," and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component. The phrase "attached to" refers to interaction between two or more entities which are in direct contact with each other or are separated from each other only by a fastener of any suitable variety. A component is positioned vertically if the longitudinal axis of the component is perpendicular (or substantially perpendicular) to the ground when the device or assembly of which it is a component is in normal use. Similarly, a component is positioned horizontally if the longitudinal axis of the component is parallel (or substantially parallel) to the ground when the device or assembly of which it is a component is in normal use. The terms "substantially perpendicular," "substantially parallel," etc., when referencing the relative orientation of objects, refer to orientations that are respectively perpendicular or parallel to each other or differ from such an orientation by about 30 degrees or less.

In some embodiments of a mobility assistance device, the mobility assistance device comprises a first base leg and a second base leg, wherein a base portion of the first base leg and a base portion of the second base leg each have dimensions configured to be disposed between a mattress and a box spring of a bed. The mobility assistance device may further comprise a support rail comprising a fixed end and an adjustable end. The adjustable end may be configured to be moved relative to the fixed end to lengthen or shorten a longitudinal dimension of the support rail. The support rail may be configured to be reversibly releasably coupled to the first base leg and to the second base leg in either a first orientation for one side of a bed or a second orientation for the other side of the bed. The adjustable end of the support rail may be configured to be oriented towards the foot of a bed in either the first or second orientations. The support rail may be configured to extend upright relative to the first and second base legs when coupled together.

In some embodiments of a mobility assistance device, the mobility assistance device comprises a first base leg and a second base leg, wherein a base portion of the first base leg and a base portion of the second base leg each have dimensions configured to be disposed between a mattress and a box spring of a bed. The mobility assistance device may further comprise a fixed end and an adjustable end. The adjustable end may be configured to be moved relative to the fixed end to lengthen or shorten a longitudinal dimension of the support rail. The support rail may comprise an upper rail portion and a lower rail portion. The upper rail portion may comprise a portion of the fixed end and a portion of the adjustable end. The lower rail portion may comprise the remainder of the fixed end and the remainder of the adjustable end. The upper and lower rail portions may be configured to be coupled together. The lower rail portion may be configured to be coupled to the first and second base legs. The support rail may be configured to extend upright relative to the first and second base legs when coupled together. The upper and lower rail portions may be configured to have similar overall length, height, and width. The upper and lower rail portions may be configured to occupy similar vertical space when horizontally stored one on top of the other.

In some embodiments of a method of using a mobility assistance device, the method comprises coupling an upper rail portion to a lower rail portion to form a support rail with a fixed end and an adjustable end. The method may further comprise reversibly releasably coupling a first base leg and a second base leg to the fixed end of the lower rail portion of the support rail, in a first orientation if the mobility assistance device is to be used on a right side of a bed, or in a second orientation if the mobility assistance device is to be used on a left side of the bed. The method may further comprise inserting base portions of the first and second base legs between a mattress and box spring of the bed.

The figures illustrate one embodiment of a mobility assistance device 100. The mobility assistance device 100 comprises various components and materials as further detailed below. Additionally, any combination of the individual components may comprise a kit for a mobility assistance device.

Figure 2:
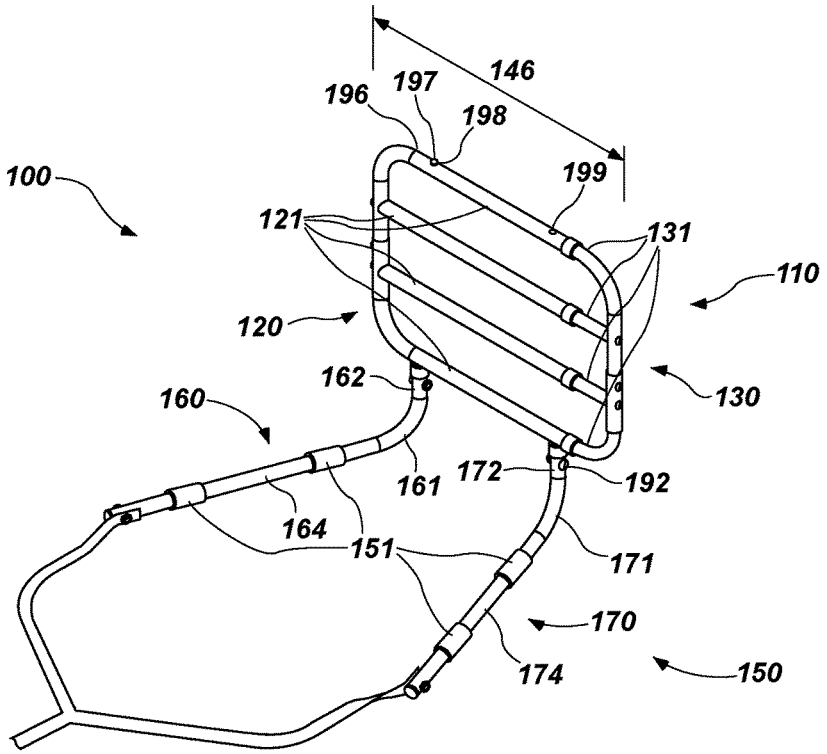
FIG. 2 is an assembled perspective view of the mobility assistance device of FIG. 1.
Figure 3:
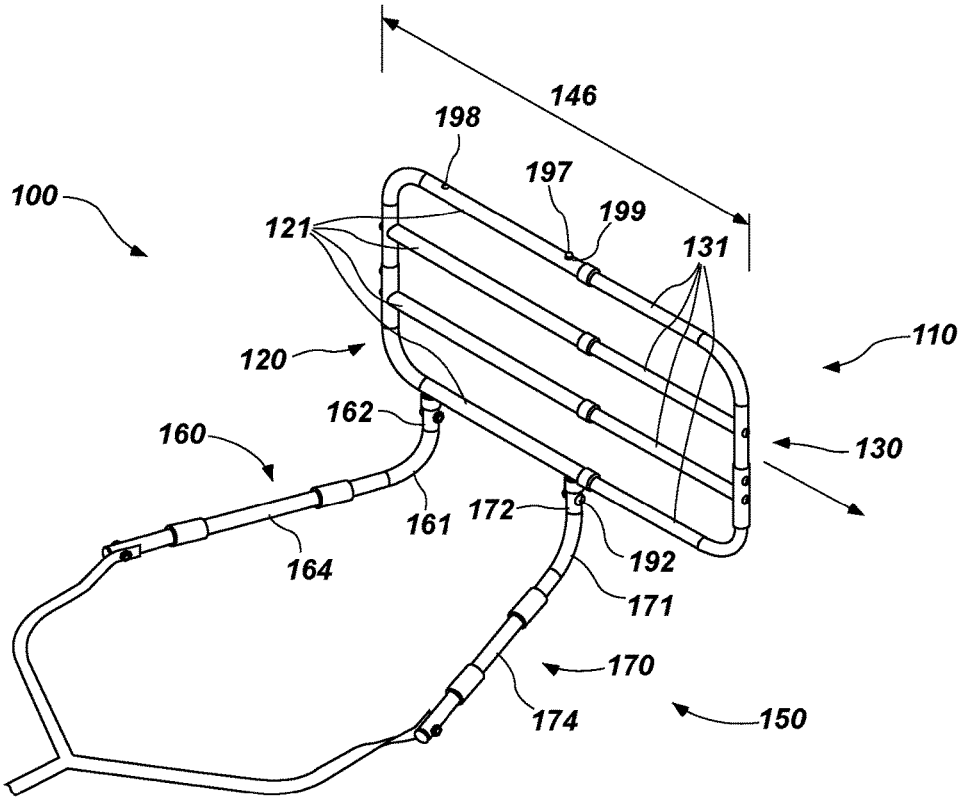
FIG. 3 is an assembled perspective view of the mobility assistance device of FIG. 1 in an extended configuration.
Figure 4:
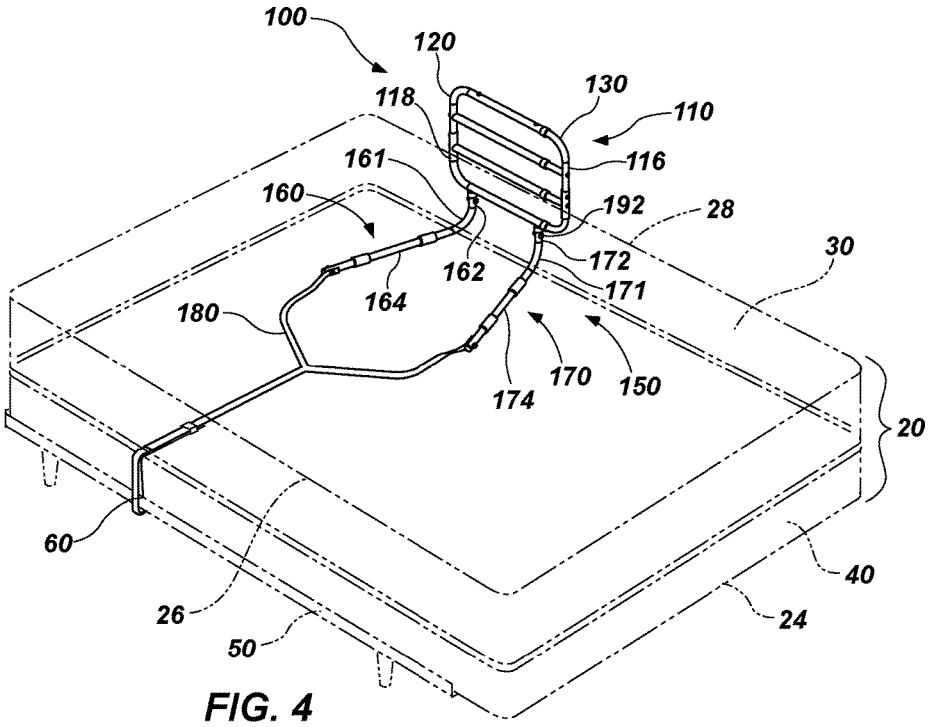
FIG. 4 is an assembled perspective view of the mobility assistance device of FIG. 1 and disposed adjacent a first side of a bed in the retracted configuration.
Figure 5:
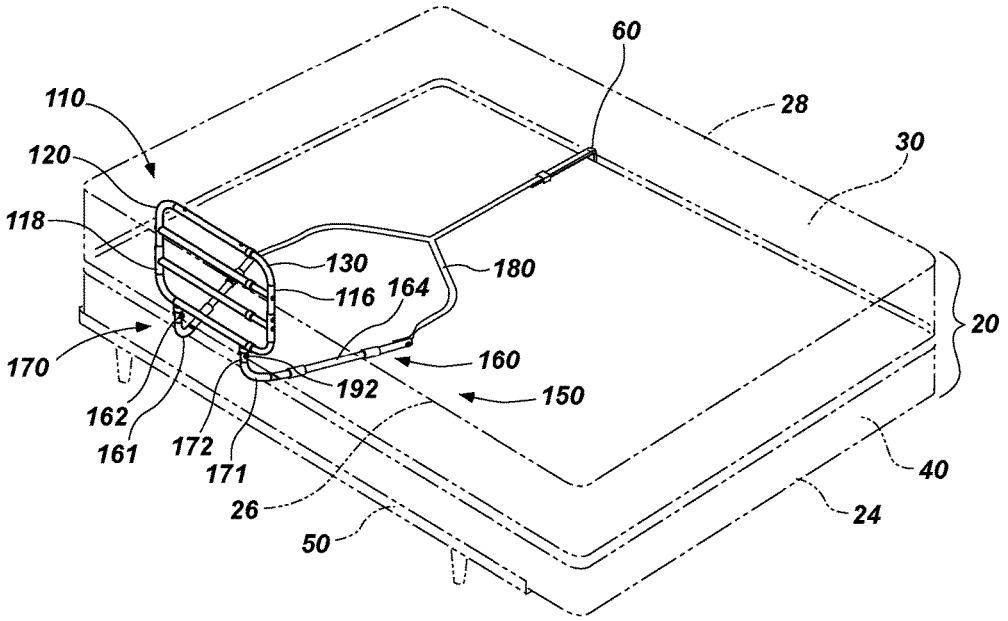
FIG. 5 is an assembled perspective view of the mobility assistance device of FIG. 1 in a second orientation disposed adjacent a second side of the bed in the retracted configuration.

FIGS. 1 and 2 depict an exploded (FIG. 1) and assembled (FIG. 2) view of the mobility assistance device 100 in a retracted configuration. FIG. 3 provides an assembled view in an extended configuration. FIG. 4 is an assembled perspective view of the mobility assistance device 100 disposed adjacent a first side of a bed in a first orientation in the retracted configuration. FIG. 5 is an assembled perspective view of the mobility assistance device 100 disposed adjacent a second side of the bed in a second orientation also in the retracted configuration. The mobility assistance device 100 may be used to assist individuals with limited mobility. Such limited mobility may arise from disease, disability, age, accident, or other causes. In particular, the mobility assistance device 100 may be configured to help individuals get into and out of reclining, sitting, supine, and/or prone positions on furniture designed for one to sit, lie down, or sleep on (e.g., a bed, a couch, or other similar furniture). In some embodiments, the mobility assistance device 100 may be configured to prevent an individual from falling out of a bed or other piece of furniture. The mobility assistance device 100 may also be used with a bed as a bed rail device.

In the illustrated embodiment, the mobility assistance device 100 includes a support rail 110, a base 150, and a securement strap 180. The base 150 is configured to be at least partially disposed between a mattress and a box spring of a bed, or underneath the cushion of a couch or other similar furniture. When disposed in such a manner, the base 150 may interact with the mattress and box spring to provide stability to the support rail 110. Thus, when a user exerts a force on the support rail 110, the base 150, mattress, and box spring may, in combination, stabilize the support rail so that it provides a sufficiently secure handle to facilitate entry into and/or exit from the bed.

As depicted in FIGS. 1 and 2, the base 150 may include a first base leg 160 and a second base leg 170. The first base leg 160 and second base leg 170 may each comprise a base portion 164, 174 having dimensions configured to be disposed between a mattress and a box spring of a bed.

The support rail 110 may be configured to be reversibly and releasably coupled to the first base leg 160 and the second base leg 170 in both a first orientation and a second orientation. In the first orientation (e.g., the orientation shown in FIG. 4), the adjustable end 130 may extend toward the foot 24 of the bed 20 when the mobility assistance device 100 is placed on a first (e.g., left) side 28 of a bed 20. In a second orientation (e.g., the orientation shown in FIG. 5), the adjustable end 130 may still extend toward the foot 24 of bed 20 when the mobility assistance device 100 is placed on the second (e.g., right) side 26 of the bed 20. In other words, the support rail 110 may be configured to be reversibly releasably coupled to the first base leg 160 and the second base leg 170 in either a first orientation for a first side 28 of a bed 20 or a second orientation for the second side 26 of the bed 20. The adjustable end 130 of the support rail 110 may be orientated toward the foot of the bed when (1) in a first orientation on one side of a bed and/or (2) in a second orientation on the opposite side of the bed.

In the first orientation, the first base leg 160 may be slidably engaged with the first tubular member 142 and the second base leg 170 may be slidably engaged with the second tubular member 144. In the second orientation, the first base leg 160 may be slidably engaged with the second tubular member 144 and the second base leg 170 may be slidably engaged with the first tubular member 142.

When the mobility assistance device 100 is assembled, the first and second base legs 160, 170 may couple to a lower rail portion 118 of a fixed end 120 of the support rail 110 at locations longitudinally separated from each other. In the illustrated embodiment, one of the base legs 160, 170 slidably engages with a first tubular member 142 while the other base leg slidably engages with a second tubular member 144. As seen in the figures, first and second tubular members 142 and 144 extend downward from a bottom surface of the lower rail portion 118 of the fixed end 120 and are longitudinally separated from each other. Thus, when the mobility assistance device 100 is assembled in the first orientation, the first base leg 160 releasably couples to the support rail 110 at only a single location (i.e., first tubular member 142), and the second base leg releasably couples to the support rail 110 at only a different single location (i.e., the second tubular member 144) and vice versa when assembled in the second orientation.

When the first base leg 160 and second base leg 170 are coupled to the support rail 110, the base portions 164, 174 of the first and second base legs 160, 170 may extend perpendicular to (or substantially perpendicular to) the support rail 110. The first and second base legs 160, 170 may also angle away from each other as the legs extend from the support rail 110. In other words, the distance between a first end 168 of the first base leg 160 and a first end 178 of the second base leg 170 may be shorter than the distance between a second end 169 of the first base leg 160 and a second end 179 of the second base leg 170 when the first and second base legs 160 and 170 are connected to the support rail 110 at the first ends 168, 178.

In the embodiment depicted in FIGS. 1 and 2, the first base leg 160 and second base leg 170 each comprise an upright portion 162, 172, a base portion 164, 174, and an elbow 161, 171. The elbows 161, 171 may be integrally formed with the upright portions 162, 172 and/or the base portions 164, 174. Alternatively, the elbows may each be a separate piece configured to couple to the upright portion and/or the base portion. The elbows 161, 171 may comprise a bend such that, when the elbows 161, 171 are coupled to both an upright portion 162, 172 and a base portion 164, 174, the upright portion 162, 172 of each leg 160, 170 is disposed perpendicular (or substantially perpendicular) to the base portion 164, 174 of that base leg 160, 170. In other embodiments, the base legs 160, 170 do not comprise elbows 161, 171, yet may still be configured to couple to the support rail 110. The first and second base legs 160, 170 may have similar dimensions. In some embodiments, the width (i.e., diameter) of the first base leg 160 is about the same as the width of the second base leg 170. The first and second base legs 160, 170 may also comprise sleeves 151 configured to slide over the base portions 164, 174, respectively. The sleeves 151 may increase the frictional engagement between the base portions 164, 174 and the mattress 30 and box spring 40 to facilitate securing the first and second base legs 160, 170 to the bed 20.

As shown in FIG. 1, the support rail 110 is configured to couple to the first base leg 160 and second base leg 170 such that the support rail 110 extends upright relative to the first and the second base legs 160, 170 when the mobility assistance device 100 is assembled. Indeed, the support rail 110 is configured to attach to the first base leg 160 and the second base leg 170 such that the support rail 110 extends above the base 150 and is disposed perpendicular (or substantially perpendicular) to the ground. Support rail 110 comprises a first tubular member 142 and a second tubular member 144 that each extend downward from a bottom surface of the support rail 110 (i.e., the bottom surface of the lower rail portion 118). The first and second tubular members 142, 144 may be configured to couple the first base leg 160 and second base leg 170 to the support rail 110 in either the first orientation or the second orientation.

For example, in the first orientation, the first tubular member 142 may be inserted into the upright portion 162 of the first base leg 160, and the second tubular member 144 may be inserted into the upright portion 172 of the second base leg 170 (i.e., for use on the left side of a bed from the perspective of someone lying in the bed). In the second orientation, the first and second base legs 160, 170 switch positions and are rotated 180 degrees. In the second orientation (i.e., for use on the right side of a bed from the perspective of someone lying in the bed), the first tubular member 142 may be inserted into the upright portion 172 of the second base leg 170, and the second tubular member 144 may be inserted into the upright portion 172 of the second base leg 170. Fasteners 192 attach the first tubular member 142 to the upright portion 162 and the second tubular member 144 to the upright portion 172 when configured in the first orientation. Likewise, the same fasteners 192 may attach the first tubular member 142 to the upright portion 172 and the second tubular member 144 to the upright portion 162 when configured in the second orientation.

In the illustrated embodiment, the fastener 192 comprises a bolt and nut. Fastener 192 fastens the first tubular member 142 with an upright portion 162 of the base leg 160 via holes in both the upright portion 162 and in the first tubular member 142 and likewise for the upright portion 172 and the second tubular member 144, when in the first orientation.

There are two assembly errors that could occur: (1) assembling the mobility assistance device 100 with one base leg in the first orientation and the other base leg in the second orientation (i.e., base leg 160 extending on one side of the support rail 110 and base leg 170 extending on the other side of the support rail 110); and (2) base legs 160 and 170 angled towards each other on the same side of the support rail 110, instead of angled away from each other. In some embodiments, the mobility assistance device 100 is configured to avoid assembly errors. In some embodiments, the outwardly facing holes of the first and second tubular members 142, 144 each comprise square holes and the inwardly facing holes comprise round holes. Likewise, each of the upright portions 162, 172 may comprise square holes in the intended outwardly facing surface and round holes in the intended inwardly facing surface. Thus, when the square hole of upright portion 162 is facing outwardly and the square hole of the upright portion 172 is facing outwardly, then the base legs 160 and 170, are both assembled in either the first orientation or the second orientation. In such embodiments, the fasteners 192 may include carriage bolts with a domed head and a square unthreaded shank attached to the underside of the head that precedes a threaded portion of the bolt.

The squares holes would make it difficult for a user to assemble the mobility assistance device 100 without aligning the square holes of the first and second tubular members 142, 144 with the square holes of the upright portions 162, 172. Thus, with the square holes aligned, a user can only assemble the mobility assistance device 100 in either the first orientation or the second orientation, with the base legs 160, 170 angled away from each other. Additionally, with the nut and threaded end of the bolt oriented inward, abrasive contact with individuals and their clothing may be avoided.

The support rail 110 may be configured to provide support for an individual during ingress and egress to and from a bed or similar furniture. For example, once the base portions 164, 174 of the base legs 160, 170 are positioned between the mattress 30 and the box spring 40, a user may grip the support rail 110 for support while lowering himself or herself onto the bed 20. Likewise, if a user desires to get out the bed 20, the user may grip the support rail 110 to swing his or her legs off the bed 20. Once in this position, the user may grasp and exert force on the support rail 110 to rise into a standing position. While moving to a standing position, the support rail 110 may assist the user in establishing his or her balance. When the mobility assistance device 100 is in an extended configuration, the device may decrease the risk of a user falling out of the bed 20.

As illustrated in FIG. 1, the support rail 110 comprises an upper rail portion 116 and a lower rail portion 118 that are configured to be coupled together with screws 193. In the illustrated embodiment, the upper rail portion 116 comprises a portion of the fixed end 120 and a portion of the adjustable end 130. The lower rail portion 118 comprises the remainder of the fixed end 120 and the remainder of the adjustable end 130. In particular, the upper rail portion 116 comprises a fixed spine 126 from which two tubular members 121 extend. The upper rail portion 116 also comprises an adjustable spine 136 from which two tubular members 131 extend. Likewise, the lower rail portion 118 comprises a fixed spine 128 from which two tubular members 121 extend. The lower rail portion 118 also comprises an adjustable spine 138 from which two tubular members 131 extend.

The fixed spine 126 and fixed spine 128 are configured to be coupled together with a screw 193. The adjustable spine 136 and adjustable spine 138 are also configured to be coupled together with a screw 193. When assembled, the fixed end 120 comprises four tubular members 121, and the adjustable end 130 comprises four tubular members 131. The tubular members 131 of the adjustable end 130 are configured to longitudinally slide within tubular members 121 of the fixed end 120, thereby lengthening or shortening the longitudinal dimension 146 of the support rail 110. Thus, compared to the retracted configuration, when the longitudinal dimension 146 is increased, less of the tubular members 131 are within the tubular members 121 of the fixed end 120.

In the illustrated embodiment, the vertical dimension (i.e., height) of the support rail 110 is fixed. In alternative embodiments, the vertical dimension of the support rail 110 may be adjustable, such as for accommodating mattresses of different thicknesses. In some embodiments, the upper rail portion 116 is adjustably coupled to the lower rail portion 118 to vary the vertical dimension of the support rail 110. For example, instead of fixed spine 126, 128 being coupled together via a single hole, the fixed spine 126 and/or the fixed spine 128 may have a row of holes for receiving screw 193. The adjustable spine 136, 138 may be similarly configured. The height of the support rail 110 would then be selected based upon which holes were used for receiving screws 193.

In some embodiments, the support rail 110 is adjustably coupled to the first and second base legs 160, 170 to vary the vertical dimension of the support rail 110. For example, instead of the first and second tubular members 142, 144 being coupled to the upright portions 162, 172 via a single hole, respectively, the first and second tubular members 142, 144 and/or the upright portions 162, 172 may have a row of holes for receiving fasteners 192. The height of the support rail 110 would then be selected based upon which holes were used for receiving fasteners 192.

FIGS. 2 and 3 illustrate modification of a longitudinal dimension 146 of the support rail 110. For example, as depicted in FIGS. 2 and 3, when assembled the fixed end 120 of the support rail 110 comprises four tubular members 121 that have an opening to receive a portion of the four tubular members 131 of the adjustable end 130. The portion of the adjustable end 130 may slide within the tubular members 121 of the fixed end 120 such that each tubular member 121 of the fixed end 120 and the portion of the adjustable end 130 disposed within it are coaxially aligned. In this fashion, tubular members 121 of the fixed end 120 may circumscribe a portion of the adjustable end 130.

If the user desires to increase the longitudinal dimension 146 of the support rail 110, the adjustable end 130 may be pulled away from the fixed end 120 in a telescopic fashion. If a user desires to decrease the longitudinal dimension 146 of the support rail 110, the adjustable end 130 may be pushed toward the fixed end 120 in a telescopic fashion. In this manner, the longitudinal dimension 146 of the support rail 110 may be expanded or contracted. In some embodiments, such expansion and/or contraction may occur while the mobility assistance device is positioned adjacent a bed as the adjustable end 130 may be configured to be moved while the base portions 164, 174 of the first and second base legs 160, 170 are disposed between the mattress and box spring of a bed.

In the illustrated embodiment, the upper and lower rail portions 116, 118 are configured to have similar overall height, width, and length. The upper and lower rail portions 116, 118 are also be configured to occupy similar vertical space when horizontally stored one on top of the other. In the illustrated embodiment, the lower rail portion 118 also comprises first and second tubular member 142, 144, which the upper rail portion 116 does not. However, the overall height of the upper rail portion 116 is about the same as the overall height of the lower rail portion 118. Or stated another way, the distance from the upper surface of the upper tubular member 121,131 of the upper rail portion 116 to the plane intersected by the ends of the fixed spine 126 and adjustable spine 136 (height of the upper rail portion 116) is about the same as the distance from the plane intersected by the end of the first tubular member 142 to the plane intersected by the ends of the fixed spine 128 and adjustable spine 138 (height of the lower rail portion 118).

In the illustrated embodiment, the tubular members 121, 131 are substantially horizontal and the fixed spines 126,128 and the adjustable spines 136, 138 are substantially vertical, creating a generally rectangular shape to support rail 110. In alternative embodiments, the support rail 110 may have any shape. Likewise, the support rail 110 may include any number of tubular members 121,131 in any geometric orientation. In some embodiments, the distance between tubular members 121,131 is selected such that a user's head would be unable to fit between the tubular members 121, 131.

The support rail 110 may also comprise a lock mechanism 196 that is configured to lock the adjustable end 130 at a particular longitudinal dimension 146 (e.g., a shortened longitudinal dimension and/or a lengthened longitudinal dimension). Such a lock mechanism 196 may be configured to be locked and unlocked by a user lying or sitting in a bed to which the mobility assistance device 100 is secured. When the lock mechanism 196 is unlocked, the user may longitudinally move the adjustable end 130 between a shortened longitudinal dimension and a lengthened longitudinal dimension.

In the illustrated embodiment, lock mechanism 196 comprises a biasable protrusion 197 located on an upper surface near the end of the upper tubular member 131 of the adjustable end 130. The biasable protrusion 197 is configured to engage with a first orifice 198, when in a retracted configuration, and with a second orifice 199, when in an extended configuration. The first and second orifices 198 and 199 are formed in an upper surface of the upper tubular member 121 of the fixed end 120, with the first orifice 198 formed near the spine end 126 and the second orifice 199 formed near the open end of the upper tubular member 121. The biasable protrusion 197 may comprise a rigid button fixed to a spring bar. The spring bar may be attached to an inner surface of the upper rail of the adjustable end 130 and the rigid button may protrude through a hole in the upper surface of the upper rail. In some embodiments, the fixed end 120 may comprise only one orifice or more than two orifices. Embodiments with more than two orifices may allow the user to select intermediate lengths for the longitudinal dimension 146.

To lengthen the longitudinal dimension 146 of the support rail, a user may depress the protrusion 197 such that it is deflected out of engagement with the first orifice 198, and the adjustable end 130 may then be slid away from the fixed end 120 until the protrusion 197 engages the second orifice 199. In a similar manner, to shorten the longitudinal dimension 146, the protrusion 197 may again be depressed and the adjustable end 130 may be slid toward the fixed end 120. When engaged, this lock mechanism 196 maintains a particular longitudinal dimension 146 of the support rail 110. Alternative embodiments may include different lock mechanisms, such as, for example, a clamp. As would be apparent to those having skill in the art with the aid of the present disclosure, alternative locking mechanisms may be used to secure the relative positions of the fixed end 120 and adjustable end 130.

FIGS. 4 and 5 depict the mobility assistance device 100 in a functional position adjacent a bed 20, with the bed 20 illustrated in phantom. The bed 20 comprises a mattress 30, a box spring 40, and a bed frame 50. As described earlier, the base portions 164, 174 of the base legs 160, 170 may be dimensioned so as be disposed between a mattress 30 and a box spring 40 of a bed 20. The elbows 161, 171 of the base legs 160, 170 may extend from below the mattress 30 upwards to adjacent the side of the mattress 30 and may be coupled to the support rail 110. The support rail 110 may extend above the mattress 30 to provide support for a user on the bed 20 or to facilitate ingress and egress to and from the bed 20.

A securement strap 180 may be used to maintain the base portions 164, 174 of the base legs 160, 170 disposed between a mattress 30 and a box spring 40. For example, in the illustrated embodiment, a "Y" shaped securement strap 180 is attached to both of the base portions 164, 174 of the first and second base legs 160, 170. As depicted in FIG. 4, the securement strap 180 may extend between the mattress 30 and the box spring 40 to the side of the bed 20 opposite the mobility assistance device 100. On the side of the bed 20 opposite the mobility assistance device 100, the securement strap 180 may wrap around a bed frame 50 or similar structure and then be pulled tight through a buckle. Alternatively, the securement strap 180 may be anchored to the mattress 30 and/or box spring 40, instead of to the bed frame 50. The securement strap 180 may be a strap of nylon, fabric, or similar construction.

In some instances, manufacturers of mobility assistance devices may desire to compactly package the devices for mass retail sale. Likewise, retailers may desire compact device storage to aid in optimizing profit per retail space, as products which are packaged in bulky containers, yet have a relatively small profit margin, may negatively impact profit per retail space.

Figure 6:
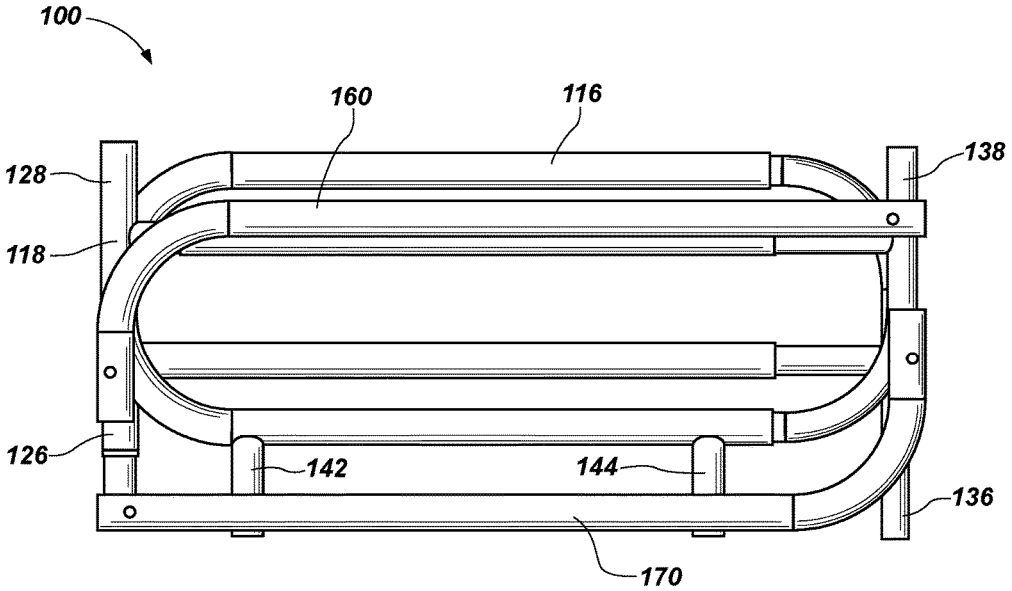
FIG. 6 illustrates one embodiment of a storage configuration of the mobility assistance device of FIG. 1.

FIG. 6 illustrates one embodiment of a storage configuration of the mobility assistance device 100. In this embodiment, the adjustable end 130 is retracted towards the fixed end 120. The support rail 110 is decoupled from the first and second base legs 160, 170. The upper rail portion 116 is uncoupled from the lower rail portion 118. The lower rail portion 118 is then laid horizontally on top of the upper rail portion 116. The first and second base legs 160, 170 are then laid horizontally on top of the lower rail portion 118.

Figure 7:
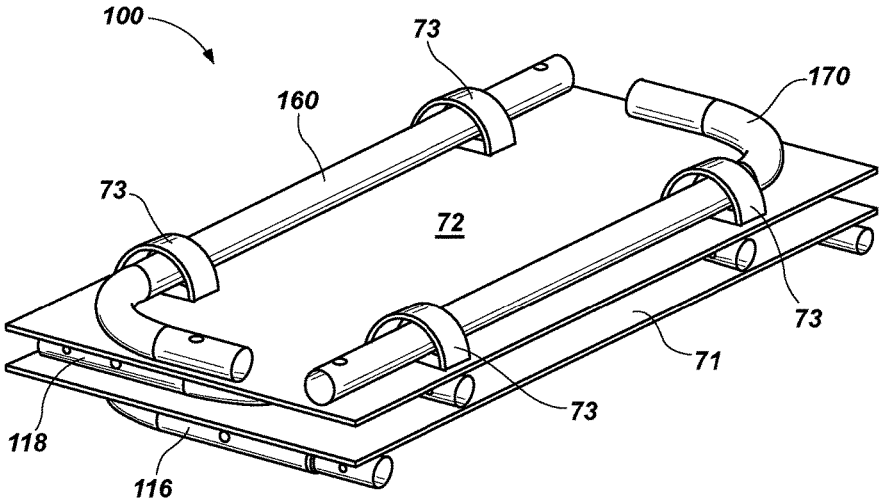
FIG. 7 illustrates the mobility assistance device 100 in the storage configuration of FIG. 6 and prepared for insertion into a box.

FIG. 7 illustrates the mobility assistance device 100 in the storage configuration of FIG. 6 and prepared for insertion into a box. A cardboard sheet 71 separates the upper rail portion 116 from the lower rail portion 118. A cardboard sheet 72 separates the first and second base legs 160, 170 from the lower rail portion 118. Cardboard loops 73 secure the first and second base legs 160, 170 to the cardboard sheet 72. Prepared in this way, the mobility assistance device 100 is configured to be packaged into a box having a height equal to about three times the width of the first and second base legs 160, 170, which is about the same as the width of the upper rail portion 116, the lower rail portion 118, and the first and second base legs 160, 170 when stacked horizontally on each other, as in FIGS. 6 and 7. The box may have a width equal to or about a height of the upper rail portion 116 or lower rail portion 118, as the heights are the same in the illustrated embodiment. The box may have a length about equal to a length of the first and second base legs 160, 170. In some embodiments, the box may have a width of about 10 inches (about 250 millimeters) and length of about 21 inches (about 525 millimeters).

As discussed previously, in the illustrated embodiment, the upper rail portion 116 and the lower rail portion 118 are configured to have overall similar height, width, and length, thereby allowing them to occupy the same vertical space. This allows the upper rail portion 116 and the lower rail portion 118 to be packaged in a smaller box as compared to a support rail that is only one piece. The mobility assistance device 100, may be assembled, positioned, disassembled, and/or packaged via a variety of methods. These methods may comprise one or more steps. One step may comprise coupling the upper rail portion 116 to the lower rail portion 118 to form the support rail 110 with the fixed end 120 and the adjustable end 130. A second step may comprise reversibly releasably coupling the first base leg 160 and the second base leg 170 to the fixed end 120 of the lower rail portion 118 of the support rail 110. In carrying out this step, a user may reversibly releasably couple the first base leg 160 and second base leg 170 to the fixed end 120 in the first orientation if the device is to be used on the first side 28 of a bed 20 or in the second orientation if the mobility assistance device is to be used on the second side 26 of the bed 20. A third step may comprise inserting base portions 164, 174 of the first and second base legs 160, 170 between the mattress 30 and the box spring 40 of the bed 20.

The methods may also comprise determining which side of the bed a mobility assistance device 100 will be secured to. The methods may also comprise attaching the strap 180 connected to the first and second base legs 160, 170 to the bed frame 50 of the bed 20 opposite the support rail 110. The methods may further comprise switching the orientation of the support rail 110 relative to the base legs 160, 170. In this step, a user may (1) remove base portions 164, 174 of the first and second base legs 160, 170 from the fixed end 120 of the lower rail portion 118 of the support rail 110, (2) recouple the first and second base legs 160, 170 to the fixed end 120 of the lower portion 118 of the support rail 110 in a different orientation, and (3) insert base portions 164, 174 of the first and second base legs 160, 170 between the mattress 30 and box spring 40 of the bed 20 on a different side of the bed 20.

The methods may further comprise removing the mobility assistance device parts from a box having (1) a height equal to about three times the width of the first and second base legs 160, 170, (2) a width equal to or about a height of the lower rail portion 118, and (3) a length about equal to the length of the first and second base legs 160, 170.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified (even if such steps are referred to as a first step, second step, etc.). Moreover, a portion of a method described herein may be a separate method. Stated otherwise, some methods may include only a portion of the steps shown in a more detailed method.

Without further elaboration, it is believed that one skill in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the invention as claimed hereinafter. In other words, various modifications and improvements of the embodiments specifically disclosed in the description above are within the scope of the appended claims.

The invention claimed is:

1. A mobility assistance device comprising:

a first base leg and a second base leg, wherein a base portion of the first base leg and a base portion of the second base leg each have dimensions configured to be disposed between a mattress and a box spring of a bed; and a support rail comprising a fixed portion and an adjustable portion, wherein the adjustable portion is configured to be moved relative to the fixed portion to lengthen or shorten a longitudinal dimension of the support rail, the support rail configured to be reversibly releasably coupled to the first base leg and the second base leg in either a first orientation for one side of a bed or a second orientation for the other side of the bed, the adjustable portion of the support rail configured to be oriented towards the foot of a bed in either the first or second orientations, the support rail configured to only extend upright relative to the base portions of the first and second base legs when coupled together, wherein the adjustable portion is configured to be moved while the base portions of the first and second base legs are disposed between a mattress and a box spring of a bed.

2. The mobility assistance device of claim 1, wherein the support rail comprises an upper rail portion and a lower rail portion, the upper rail portion comprising a portion of the fixed portion and a portion of the adjustable portion, the lower rail portion comprising the remainder of the fixed portion and the remainder of the adjustable portion, wherein the upper and lower rail portions are configured to be releasably coupled together.

3. The mobility assistance device of claim 1, wherein when coupled to the support rail, the base portions of the first and second base legs are configured to extend perpendicular to the support rail and are configured to be angled away from each other.

4. The mobility assistance device of claim 1, wherein the first base leg reversibly releasably couples to the support rail at only a single location and wherein the second base leg reversibly releasably couples to the support rail at only a different single location.

5. The mobility assistance device of claim 1, wherein the first and second base legs each are reversibly releasably coupled to the fixed portion of the support rail at locations longitudinally separated from each other.

6. The mobility assistance device of claim 5, wherein the first and second base legs each reversibly releasably coupled to the lower rail portion of the fixed portion comprises one of the first and second base legs slidably engaged with a first tubular member extending downwards from a portion of the fixed portion, the other of the first and second base legs slidably engaged with a second tubular member extending downwards from a different portion of the fixed portion, wherein the first and second tubular members are longitudinally separated from each other.

7. The mobility assistance device of claim 6, wherein when the support rail is reversibly releasably coupled to the first base leg and the second base leg in the first orientation, then the first base leg is slidably engaged with the first tubular member and the second base leg is slidably engaged with the second tubular member, and wherein when the support rail is reversibly releasably coupled to the first base leg and the second base leg in the second orientation, then the first base leg is slidably engaged with the second tubular member and the second base leg is slidably engaged with the first tubular member.

8. The mobility assistance device of claim 7, wherein the first base leg is configured to only slidably engage with the first tubular member when in the first orientation and is configured to only slidably engage with the second tubular member when in the second orientation, and wherein the second base leg is configured to only slidably engage with the second tubular member when in the first orientation and is configured to only slidably engage with the first tubular member when in the second orientation.

9. The mobility assistance device of claim 1, further comprising a strap attached to the base portions of the first and second base legs, the strap configured to be attached to a frame of a bed, on a side of a bed opposite the support rail.

10. A mobility assistance device comprising:

a first base leg and a second base leg, wherein a base portion of the first base leg and a base portion of the second base leg each have dimensions configured to be disposed between a mattress and a box spring of a bed; and a support rail comprising a fixed portion and an adjustable portion, wherein the adjustable portion is configured to be moved relative to the fixed portion to lengthen or shorten a longitudinal dimension of the support rail, the support rail comprising an upper rail portion and a lower rail portion, the upper rail portion comprising a portion of the fixed portion and a portion of the adjustable portion, the lower rail portion comprising the remainder of the fixed portion and the remainder of the adjustable portion, the upper and lower rail portions are configured to be coupled together, the lower rail portion is configured to be coupled to the first and second base legs, the support rail is configured to only extend upright relative to the base portions of the first and second base legs when coupled together.

11. The mobility assistance device of claim 10, wherein a width of the first and second base legs is about the same as the width of the upper rail portion and about the same as the width of the lower rail portion.

12. The mobility assistance device of claim 10, wherein the mobility assistance device is configured to be packaged into a box having a height equal to about three times a width of the first and second base legs, the box having a width equal to about a height of the lower rail portion, and the box having a length about equal to a length of the first and second base legs.

13. The mobility assistance device of claim 10, wherein the support rail is configured to be reversibly releasably coupled to the first base leg and the second base leg in either a first orientation for one side of a bed or a second orientation for the other side of the bed, the adjustable portion of the support rail configured to be oriented towards the foot of a bed in either the first or second orientations.

14. The mobility assistance device of claim 10, wherein the upper and lower rail portions are configured to be adjustably coupled together to vary a vertical dimension of the support rail.

15. A mobility assistance device comprising:

a first base leg and a second base leg, wherein a base portion of the first base leg and a base portion of the second base leg each have dimensions configured to be disposed between a mattress and a box spring of a bed; and a support rail comprising a fixed portion and an adjustable portion, wherein the adjustable portion is configured to be moved relative to the fixed portion to lengthen or shorten a longitudinal dimension of the support rail, wherein the support rail is configured to only extend upright relative to the base portions of the first and second base legs when the first and second base legs are coupled to the support rail, wherein the support rail is configured to be adjustably coupled to the first and second base legs to vary a vertical dimension of the support rail.

16. The mobility assistance device of claim 15, wherein the adjustable portion of the support rail comprises tubular members configured to longitudinally slide within tubular members of the fixed portion.

17. The mobility assistance device of claim 15, further comprising a single lock mechanism configured to lock the adjustable portion in a shortened longitudinal dimension and a lengthened longitudinal dimension, wherein the single lock mechanism is configured to be locked and unlocked by a user lying or sitting in a bed to which the mobility assistance device is secured, and wherein when the single lock mechanism is unlocked, the user can longitudinally move the adjustable portion between the shortened longitudinal dimension and the lengthened longitudinal dimension.

18. The mobility assistance device of claim 15, wherein the first base leg and the second base leg have similar dimensions.

19. The mobility assistance device of claim 15, wherein the first and second base legs each are reversibly releasably coupled to the fixed portion of the support rail at locations longitudinally separated from each other.

20. The mobility assistance device of claim 15, wherein the support rail is configured to be reversibly releasably coupled to the first base leg and the second base leg in either a first orientation for one side of a bed or a second orientation for the other side of the bed, the adjustable portion of the support rail configured to be oriented towards the foot of a bed in either the first or second orientations.

* * * * *